United States Patent [19]

Burke

[11] 3,971,031

[45] July 20, 1976

[54] LOADED QUAD ANTENNA

[76] Inventor: Emmett F. Burke, 4501 Vallacher Ave., Minneapolis, Minn. 55416

[22] Filed: Oct. 31, 1975

[21] Appl. No.: 627,525

[52] U.S. Cl. ..... 343/744; 343/722; 343/750

[51] Int. Cl.² ..... H01Q 7/00

[58] Field of Search ..... 250/744, 722, 741, 750, 250/868

[56] References Cited

UNITED STATES PATENTS

| | | | |
|---|---|---|---|
| 2,655,599 | 10/1953 | Finneburgh | 343/722 |
| 3,737,907 | 5/1973 | Monola | 343/744 |
| 3,740,753 | 6/1973 | Monola | 343/744 |

*Primary Examiner*—Harold A. Dixon
*Attorney, Agent, or Firm*—Stuart R. Peterson

[57] ABSTRACT

A driven quad antenna unit includes four perpendicularly arranged antenna elements, each element containing therein a high Q load coil in order to reduce the overall size of the antenna structure. A similarly configured parasitic loop unit functioning as a director or reflector (or both may be employed) is located in front or behind, as the case may be, the driven antenna unit. As with the driven unit, each side of the parasitic unit has a coil connected therein, the number of turns in each coil of the director being somewhat less than in the number in the coils of the driven unit and somewhat greater in the coils of the reflector.

12 Claims, 11 Drawing Figures

LOADED QUAD ANTENNA

BACKGROUND OF THE INVENTION

1. Field of the Invention

This invention relates generally to quad antennas and pertains more particularly to such an antenna in which a load coil is connected in each side thereof.

2. Description of the Prior Art

Various antenna structures have been designed in the past. Among such structures are the so-called quad antennas. Difficulties, however, have been encountered with quad antennas, particularly in the frequency range between 12 and 30 megahertz (MHz). Antennas operable at these frequencies require rather heavy supporting structures due to the size, weight and wind resistance of their antenna elements. Directional arrays are especially vulnerable to wind with the consequence that some quad-type antennas cannot be used where higher than normal wind velocities prevail. Also, the larger the antenna elements (and increased size of the associated supporting structure therefor), the more prone the overall assembly is to collecting ice during winter months, thereby further aggravating the weight and wind resistance problems. Consequently, the use of quad antennas has been mainly restricted to installations where optimum environmental conditions exist, both as to weather and space.

SUMMARY OF THE INVENTION

Accordingly, one important object of the present invention is to reduce appreciably the physical size of a quad antenna. More specifically, an aim of the invention is to decrease the size to only one-fourth the area of a conventional quad antenna for a given frequency. Still further, it is within the purview of the invention to retain the desirable characteristics of conventional quad antennas as far as directivity and gain are concerned. Not only is the physical size of the antenna reduced, but the lighter weight supporting structure renders the antenna less vulnerable to higher wind velocities. Still further, owing to the overall light weight of the complete antenna structure, a more compact and less powerful rotating mechanism for the boom can be employed. Yet another advantage, stemming from the smaller size, is that the antenna is less visible and its utility concomitantly enhanced as far as military applications are concerned. Actually, this advantage holds true wherever aesthetic factors are to be considered.

Another object of the invention is to achieve the foregoing reduction in antenna size without significantly increasing the cost of the antenna. In this regard, the use of loading coils increases the cost somewhat, but the benefits to be derived from a practicing of my invention far outweigh or offset the additional coil expense. For instance, an aim of the invention, through the agency of the coils and adjustable taps provided in conjunction therewith, is to enable the antenna to be finely tuned so that a high front to back gain is realized and a low voltage standing wave ratio (VSWR) obtained at the same time. Stated somewhat differently, a fairly narrow bandwidth is achieved for a high front to back gain and low VSWR. More specifically, where load coils are utilized in the driven and reflector elements, these load coils can each be adjusted as far as their individual inductances are concerned so that the elements are finely tuned for whatever specific portion of the frequency band most frequently used. While the antenna can be tuned by adjusting the tap on each coil, it is of advantage to be able to adjust the various coil taps until approximately the most precise tuning is realized and then adjust only one coil tap in the final tuning procedure, doing so on a particular driven element and also on one of the correspondingly positioned elements on the director or reflector, as the case may be.

Still another object of the invention is to provide a quad antenna system or array composed of a driven quad, director and reflector in which the straight conductive wire sections of all the units can possess the same physical length, the only difference being in the use of coils differing in the number of turns or convolutions so that the parasitic elements can be tuned to a higher (for the director) or lower (for the reflector) frequency than that which the driven elements are tuned. Not only can the wire lengths be the same, but additional simplification can be realized in that the various spreaders utilized in maintaining the antenna elements of the driven and parasitic quad configurations in their perpendicular or right angle relationship can all be the same length.

Yet another object of the invention is to provide a simple arrangement for attaching or mounting the antenna wire sections of a quad loop to the ends of the spreader arms.

Briefly, my invention comprises a quad antenna having its antenna elements arranged perpendicularly to each other and held in this configuration by appropriate supporting structure, as is conventional with antennas of this type. Contained in each antenna element in a serial relationship with the straight wire sections of the elements are loading coils having a high Q factor (high reactance to resistance), each coil having an adjustable wire tap associated therewith so that each coil can be individually adjusted as to its inductance, thereby enabling the operator to finely tune the antenna to the precise frequency of the signal he desires to receive or transmit. The invention permits the physical size of a quad-type antenna to be reduced to only one-fourth the area of a full size quad antenna for the same frequency.

DESCRIPTION OF THE PREFERRED EMBODIMENT

Figure 1:
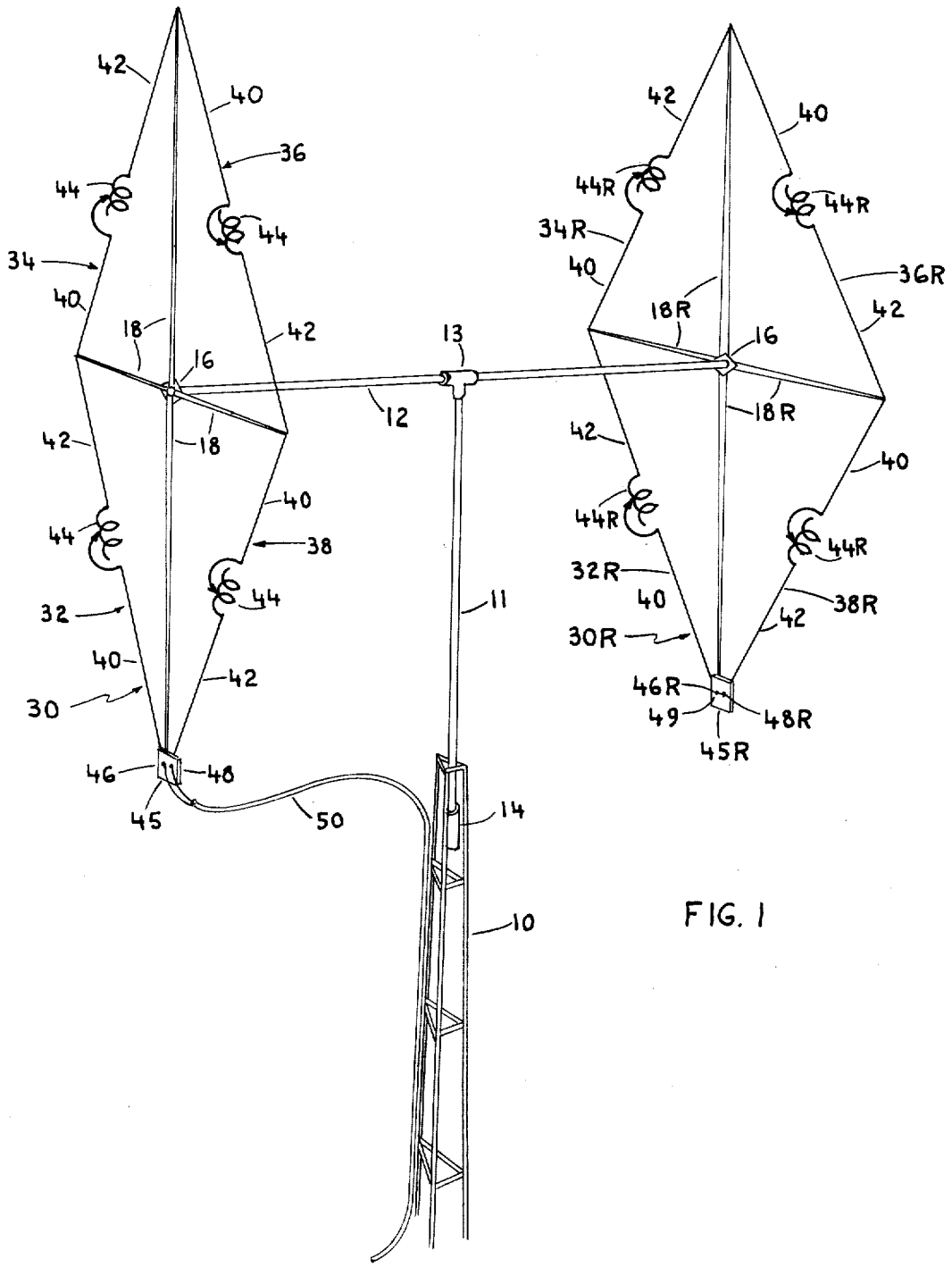
FIG. 1 is a perspective view of a complete antenna assembly constructed in accordance with the teachings of my invention, the view showing a quad-type antenna array rotatably mounted on a tower and mast.
Figure 2:
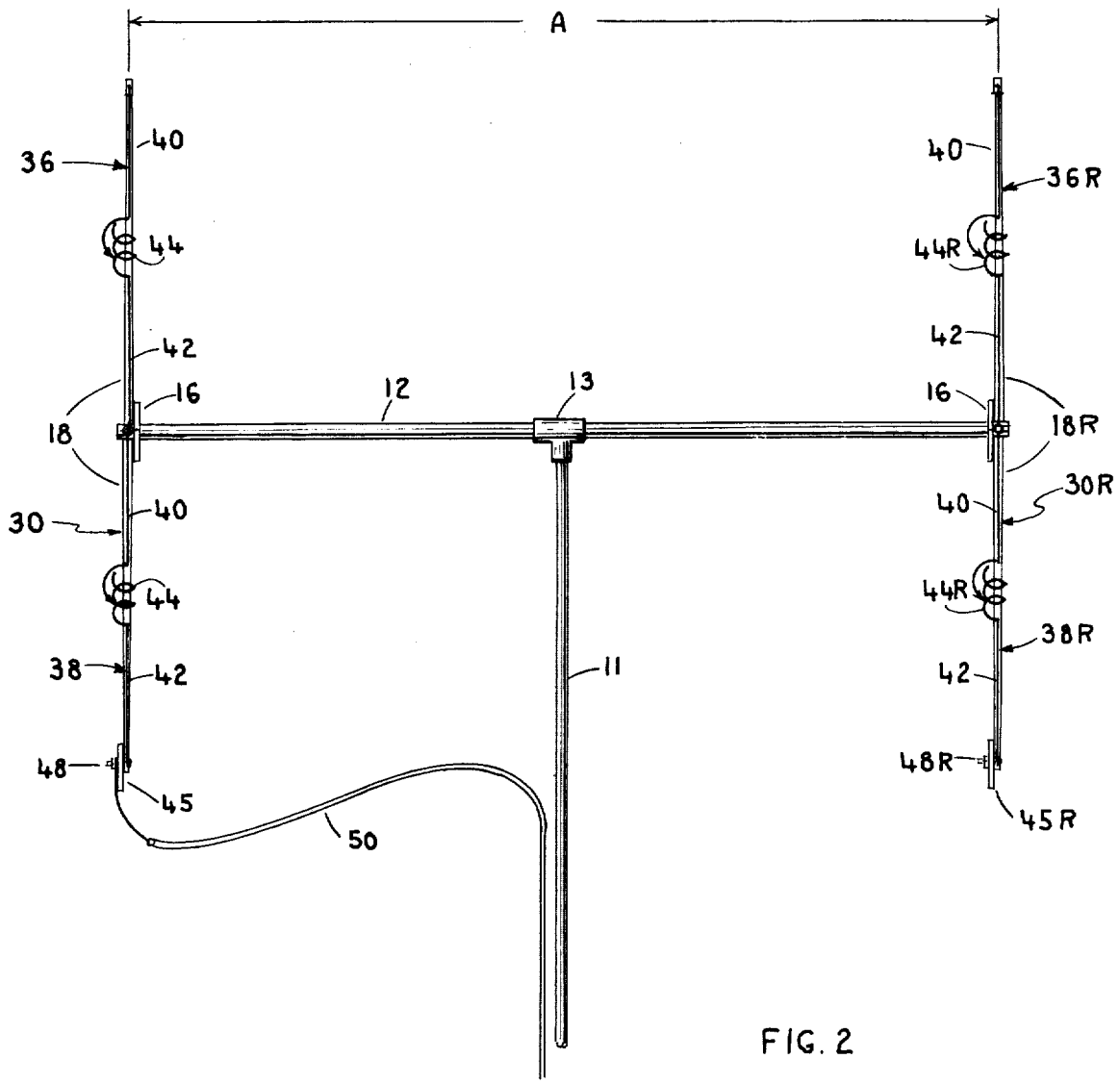
FIG. 2 is a side elevational view of the antenna array depicted in FIG. 1.

For the sake of completeness, although not a part of my invention, a tower 10 has been depicted in FIG. 1 having a rotatable mast 11 extending upwardly therefrom, the upper portion of the mast 11 also appearing in FIG. 2. Supported by a fitting 13 at the upper end of the mast 11 is a horizontal boom 12, there being a rotator 14 (FIG. 1) at the lower end of the mast 11 via which the mast 11 is rotated so that the boom can be swung into an optimum transmitting or receiving angle.

Figure 4:
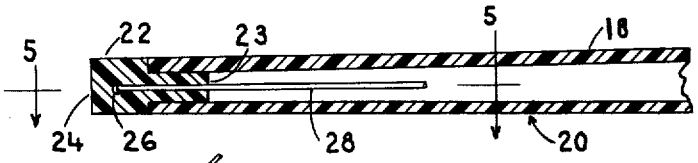
FIG. 4 is an enlarged sectional detail taken in the direction of line 4—4 of FIG. 3 for the purpose of depicting how the antenna wire section is mounted at one end of a spreader.
Figure 5:
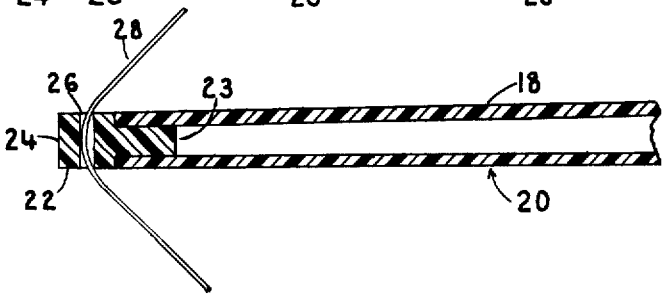
FIG. 5 is a sectional view taken in the direction of line 5—5 of FIG. 4 for the purpose of illustrating even more clearly the mounting of the antenna wire.

By means of a clamp 16, four spreader arms 18 are mounted at one end of the boom 12 and a similar number of spreader arms 18R are mounted at the other end of the boom 12. As can be discerned from FIGS. 4 and 5, the spreader arms 18 are in the form of tubular rods 20. Preferably, the tubular rods 20 are of bamboo, aluminum, and even more desirably, reinforced fiber glass. A wire support or fitting 22 is shaped so that one end thereof can be pressed into the upper arm 18 and each of the two horizontal arms 18, the fitting 22 having a reduced diameter portion 23 at one end and a larger diameter portion 24 (of the same diameter as the tubular spreader arm) at the other end. The larger end 24 has a hole 26 drilled therethrough for the accommodation of a portion of an antenna wire 28 as will presently be explained more fully.

The arms 18 provide a supporting structure for a driven unit denoted generally by the reference numeral 30, whereas arms 18R form a supporting structure for a parasitic unit denoted generally by the reference numeral 30R, more specifically in the illustrated situation a reflector. Inasmuch as the driven and reflector units 30, 30R are quite similar, the suffix "R" has been added to the reference numerals signifying or indicating the corresponding parts. The driven unit 30 comprises four elements labeled 32, 34, 36 and 38, whereas the reflector unit comprises four elements labeled 32R, 34R, 36R and 38R.

Each element 32, 34, 36, 38 and 32R, 34R, 36R and 38R includes a first straight wire section 40, a second straight wire section 42 and a high Q loading coil 44, the coil contained in each reflector element having been distinguished by the suffix "R" since the coils 44R differ from the coils 44 only in that they include more turns. A terminal block 45, having a pair of terminals 46, 48 thereon, is fastened to the free end of the lower vertical arm 18 (and also a second block 45R to the free end of the lower vertical arm 18R). The first section 40 of the element 32 is connected to the terminal 46 and similarly the second section 42 of the element 38 is connected to the terminal 48. A coaxial transmission line 50 extends from the terminals downwardly to the transmitter and/or receiver (not shown). The terminals 46R and 48R on reflector unit 30R are bridged with a short length of No. 12 copper wire 49. The various straight wire sections 40, 42 can be of No. 12 gauge soft or medium hard drawn copper wire. As the description progresses, it will be appreciated that the antenna units 30, 30R are not subjected to any great amount of longitudinal stress or tension due to the small size of the elements 32, 34, 36, 38 and 32R, 34R, 36R, 38R antenna structure comprising the support arms.

It can be pointed out at this time that the first section 40 of the element 32 has a certain length; likewise, the second section 42 of the element 32 has the same length. The second wire section 42 of the element 32 and the first wire section 40 of the adjacent element 34 are integral with each other. As can be seen from FIG. 5 in particular, the single length of wire constituting the sections 40, 42 can be threaded through the hole 26 in the fitting 22 and in this way firmly mounted or held in place. Also, as is typical with quad antennas, the various elements 32, 34, 36 and 38 are oriented at right angles to each other. Still further, each element by reason of the straight wire sections 40, 42 and coil 44 (44R as far as the reflector 30R is concerned) can be adjusted, as will hereinafter be explained, to an effective or equivalent electrical length (not actual or physical length) of one-quarter wavelength.

At this time, attention is directed to the specific construction of the load coils 44, 44R. The various load coils 44 connected serially into the elements 32, 34, 36 and 38 constituting the driven unit 30 are all of one inductance. The coils 44R included in the reflector elements 32R, 34R, 36R and 38R can likewise be of all one inductance, although greater, the latter having more turns or convolutions contained therein inasmuch as the reflector elements 32R, 34R, 36R and 38R are to be adjusted to frequencies slightly lower, about 4% lower, than the transmitting or receiving frequencies for which the driven elements 32, 34, 36 and 38 are tuned.

Figure 7:
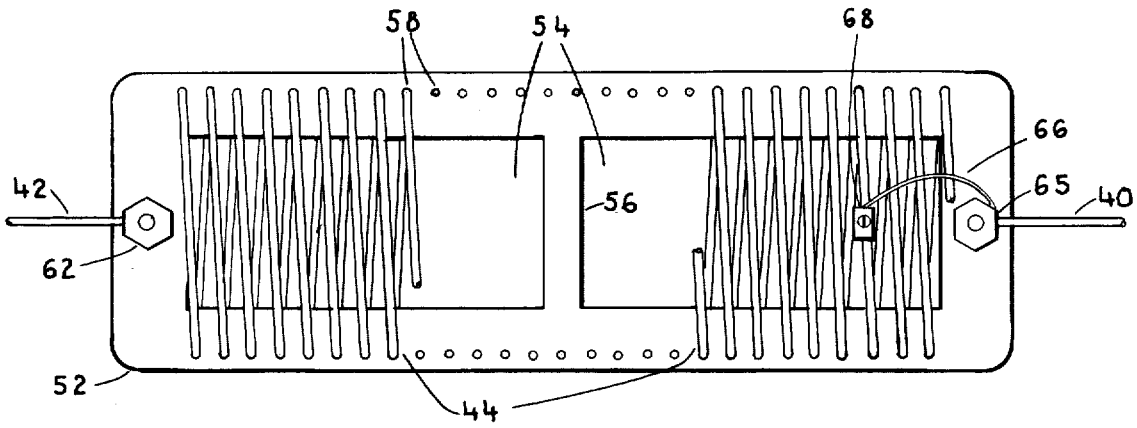
FIG. 7 is a top plan view of FIG. 6.
Figure 6:
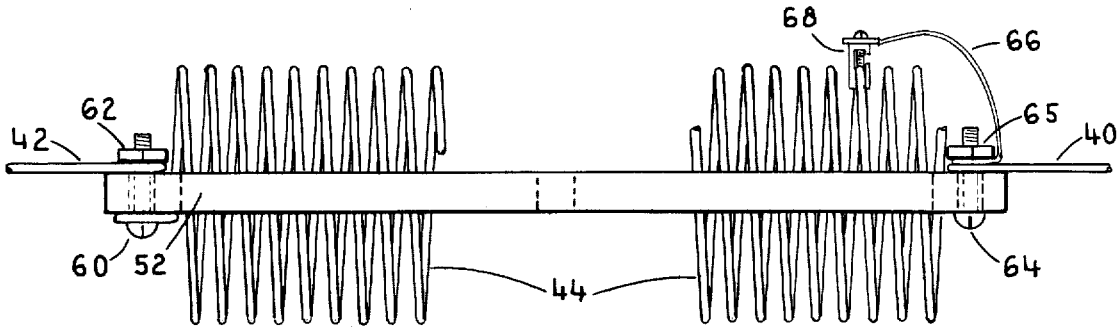
FIG. 6 is a side elevational view of one of the loading coils appearing in FIG. 3, the view being taken in the direction of line 6—6 of FIG. 3.

Describing the specific construction of the coils 44 (and 44R), as can be understood from FIGS. 6 and 7, each coil 44 is mounted on a rectangular form 52, preferably of acrylic plastic (Plexiglas), having openings 54 therein which result in a bridging portion 56. The rectangular openings 54 not only reduce the weight of the coil assembly but also reduce the wind resistance thereof. Holes are drilled along each side or marginal portion of the form 52 for the accommodation of the wire constituting the coil 44. The wire is suggestively of Copperweld No. 14 wire. In fabricating the coil 44, it is first wound on a cylinder (not shown) having a diameter slightly less than the ultimate diameter desired for the coil, the coil then being permitted to expand slightly.

The freed coil, after release from the forming cylinder, is at that time threaded through the various holes 58 and terminated at one end of the form 52 by means of a bolt 60. The wire constituting the coil 44 is sufficiently soft so that it can easily be bent around the shank of the bolt 60 and a nut 62 applied to the bolt 60 will then secure this end of the coil 44 in a fixed relation to the form 52. A similar bolt 64 having a nut 65 thereon is utilized at the other end of the coil 44 but it will be observed that the wire is not terminated or connected to the bolt 64 in this instance. Instead, a short wire 66 is connected to the bolt 64 and functions as a jumper or tap which detachably connects to a preferred portion of the wire constituting the coil 44. It is important to observe that a clip 68 at the free end of the wire 66 permits attachment to a portion of the coil nearer the unterminated end. In other words, the terminated end of the coil 44 is connected to the second section 42 of each element, whereas the tap 66 is connected to the first wire section 40 of each element 32, 34, 36, 38 (and similarly to the first wire section 40 of the elements 32R, 34R, 36R, 38R).

As a general matter, it should be recognized that the various elements 32, 34, 36 and 38 contained in the driven unit 30 produce a one-quarter wavelength effect. In other words, if the entire perimeter which would include all of the straight wire sections 40, 42 and all of the coils 44 are taken into account, the electromagnetic length would be one complete wavelength. An electrical length of one wavelength is conventional as far as quad antennas are concerned. By using the coils 44 and 44R, though, the overall physical size is approximately one-quarter of that of conventional quad antennas.

Figure 3:
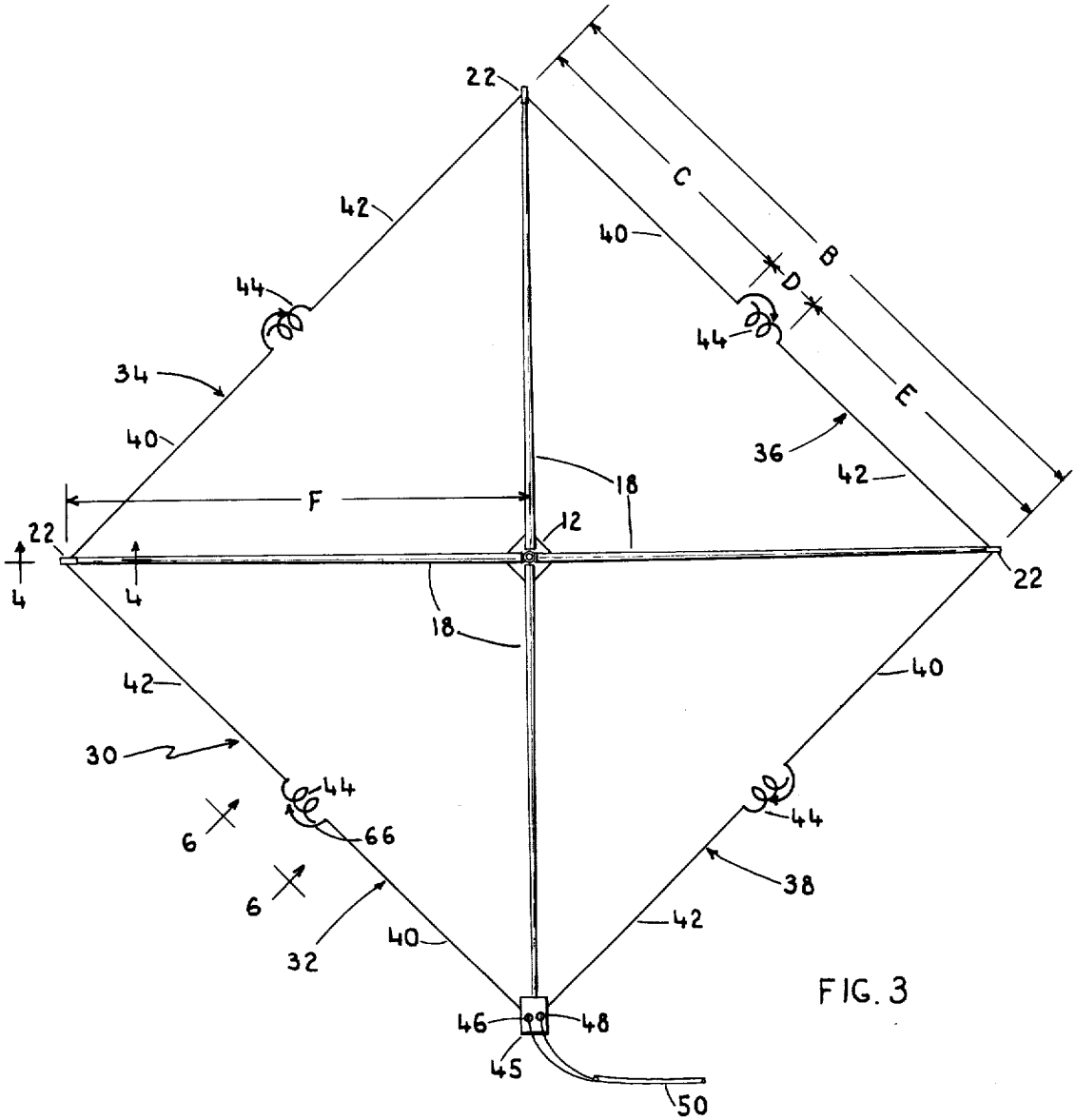
FIG. 3 is an end elevational view illustrating the driven unit of the array.

With the full four-quarter wavelength (one-quarter on each side) effect in mind, it will be helpful to point out that antenna arrays have been constructed for both the 14 and 21 MHz amateur bands. Although an antenna constructed in accordance with the teachings of my invention can be modified for use with other frequencies, it is thought that by providing sufficient data regarding the two mentioned bands, the invention will be adequately described so that anyone familiar with the antenna art can fabricate antennas for whatever frequency he is most interested in. Actually, the combined antenna array or assembly constructed for the 14 and 21 MHz bands was mounted on a single boom and tower. However, to show both antenna constructions would only complicate the drawings unnecessarily. It is believed that letter designations, which have been applied to certain of the figures, will be of benefit, though, in arriving at an optimum antenna. The physical dimensions (FIGS. 2 and 3) listed below are in feet:

| 14 MHz | 21 MHz |
|---|---|
| A = 10.00 | A = 7.00 |
| B = 9.25 | B = 6.167 |
| C = 4.396 | C = 2.917 |
| D = 0.458 | D = 0.333 |
| E = 4.396 | E = 2.917 |
| F = 6.54 | F = 4.36 |

It can be explained at this point that the Q of the various coils 44 when silverplated is approximately 400. As far as the approximate inductance of each coil 44 is concerned, it can be stated that for the 14 MHz band the coils 44 would each have on the order of 9.54 microhenries and for the 21 MHz band the coils 44 would each have an inductance of approximately 6.4 microhenries.

Inasmuch as a basic objective of the present invention is to reduce appreciably the size of a quad antenna, it will be of interest to compare the lengths of the elements 32, 34, 36, 38 for the normal or conventional quad antenna with the corresponding lengths for a modified quad antenna constructed in accordance with the teachings of the present invention. Therefore, attention should be directed to FIG. 3 where the letter B represents the length of each element. From the foregoing tabulation, it will be observed that for a frequency of 14 MHz, the dimension B is 9.25 feet and for the 21 MHz band the length is 6.167 feet. By contrast, the length of a conventional quad element for the 14 MHz band without any loading coil contained therein would be 17.5 feet, whereas the corresponding element length for the 21 MHz band would be 11.8 feet. Thus, it will be seen that there is a decided reduction in size as far as the length of each element is concerned, amounting to an area reduction on the order of 4 to 1.

Figure 8:
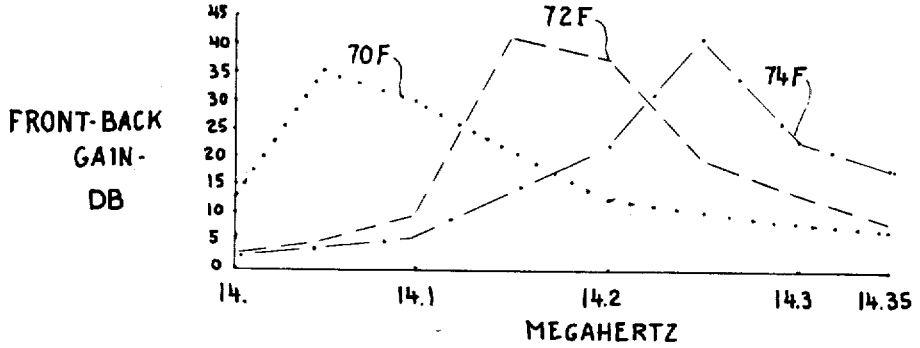
FIG. 8 is a graphical representation of the front to back gain plotted against frequency for three different numbers of turns for a driven antenna coil and a corresponding related number of turns for a reflector coil.

Since it is important to have an optimum front to back gain, attention is directed to FIG. 8 which represents graphically the front to back (F/B) gain relationship for 14 MHz. Actually, three curves have been plotted with the ordinate representing the decibel front/back gain and the abscissa the particular frequencies. The dotted curve labeled 70F is with 23.5 turns or convolutions contained in each driven coil 44 and 24.25 turns or convolutions contained in each reflector coil 44R. The dashed line 72F represents 22.875 turns or convolutions in each coil 44 and 23.875 turns in each coil 44R. The alternating dot and dash line 74F is indicative of the situation where 22.875 turns or convolutions are present in each driven coil 44 and 23.687 in each reflector coil 44R.

Figure 9:
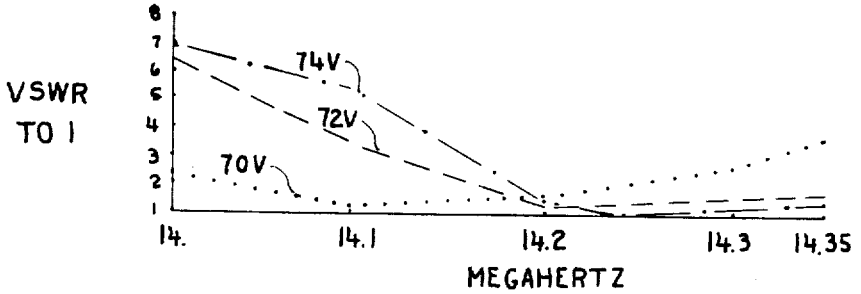
FIG. 9 is another graph, this one showing the voltage standing wave ratio plotted against frequency for the same turn relations used in plotting FIG. 8.

Since it is important to have a low voltage standing wave ratio (VSWR), FIG. 9 represents in a similar fashion the voltage standing wave relationship as the ordinate and this is plotted against frequency. Thus, it will be seen that the VSWR ration is relatively low for optimum front/back gain. Using the same turn relationships mentioned above, the curve 70V portrays the same turn conditions as curve 70F, curve 72V the same as 72F and curve 74V the same as 74F.

Figure 10:
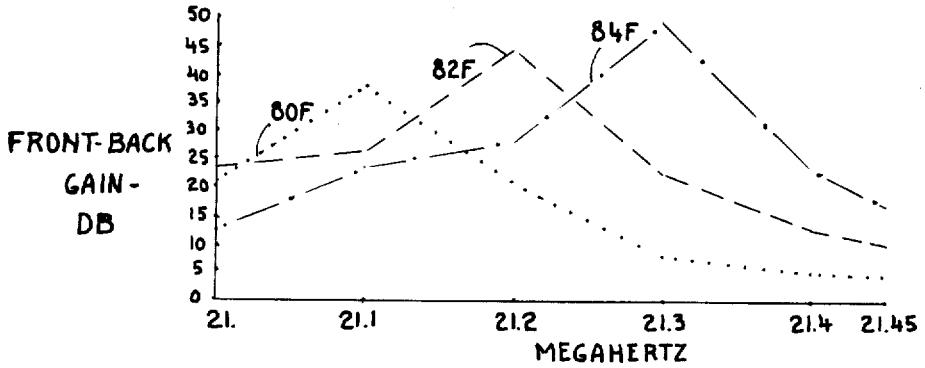
FIGS. 10 and 11 are graphs corresponding generally to FIGS. 8 and 9 with the appropriate number of coil turns for the driven and reflector units when the antenna is used for a higher frequency.
Figure 11:
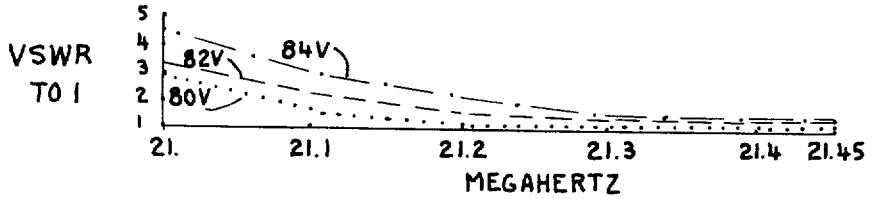

Passing now to FIGS. 10 and 11, it will be recognized that these graphs represent the 21 MHz band. Therefore, the number of turns per coil 44 and per coil 44R differs from that given for FIGS. 8 and 9 which relate to the 14 MHz band. More specifically, curves 80F and 80V were derived with 15.375 turns in each driven element 32, 34, 36, 38 and 16.375 turns in each reflector element 32R, 34R, 36R, 38R. Curves 82F and 82V were obtained with 15.25 turns and 16.25 turns, respectively, whereas curves 84F and 84V are based on turns of 15.125 and 16.062, respectively.

From the foregoing, it should be apparent to those acquainted with the antenna art, particularly those familiar with the problems associated with quad antennas employed for transmitting or receiving radio signals in the 12 to 30 MHz range, that a substantial advantage is to be gained by using my loaded coil antenna because of the attendant reduction in physical size, yet without a loss of operating criteria normally expected from conventional quad antennas. The field strength tests were made at a distance of 230 wavelengths from a 14 MHz antenna constructed in accordance with my invention and also at a distance of 340 wavelengths from a 21 MHz antenna embodying my coil concept. In conducting the experiments, tests were made by comparing the signal strength of the antenna when directed toward the measuring location and with the signal directed 180° away from the measuring location. Differences of 40 to 50 decibels in signal strength were measured at the resonant frequencies of the two transmitting antennas, that is 14 MHz in one case and 21 MHz in the other. Tests at receiving stations 9,000 to 10,000 miles away resulted in reports of strong signals when the transmitting antenna was directed by the great circle route toward the receiving locations. Zero field strength (nulls) were obtained on both the shorter (230 and 340 wavelengths) and longer (9,000 to 10,000 miles) distance tests when the transmitting antenna was rotated through 90° from the direct beam path. Weak to moderate signal strengths were reported when the transmitting antenna was rotated from 95° to 180° from the receiving or measuring locations. Therefore, it should be evident that the performance of my antenna is indeed outstanding.

I claim:

1. An antenna structure comprising first, second, third and fourth antenna elements, each element having a loading coil serially connected therein, and means for supporting said elements in a substantially common plane with each element oriented generally perpendicular to the other.

2. An antenna structure in accordance with claim 1 in which each of said elements includes first and second straight conductive sections with the coil of each element being connected intermediate the first and second sections thereof.

3. An antenna structure in accordance with claim 2 in which for a frequency of 14 MHz said straight sections each have a length of approximately 4.4 feet and said coils each have an inductance of approximately 9.54 microhenries.

4. An antenna structure in accordance with claim 3 including an adjustable tap associated with each coil for varying the inductance thereof.

5. An antenna structure in accordance with claim 2 in which for a frequency of 21 MHz said straight sections each have a length of approximately 2.9 feet and said coils each have an inductance of approximately 6.4 microhenries.

6. An antenna structure in accordance with claim 5 including an adjustable tap associated with each coil for varying the inductance thereof.

7. An antenna structure in accordance with claim 1 in which increasing the number of turns in each coil increases with wavelength.

8. An antenna structure in accordance with claim 1 in which the first straight section of said second element is integral with and constitutes a right angle continuation of the second section of said first element, in which the first straight section of said third element is integral with and constitutes a right angle continuation of the second section of said second element, in which the first straight section of said fourth element is integral with and constitutes a right angle continuation of the second section of said third element, the ends of the first and second sections of the first and fourth elements remote from the coils contained in said first and fourth element providing transmission line feed points.

9. An antenna structure in accordance with claim 1 in which one end of each coil contained in each element is fixedly attached to one end of one straight section and an adjustable tap for each coil connecting a selected portion of its coil to the other straight section for that element.

10. An antenna structure in accordance with claim 9 in which said coils each contain between 20–30 turns or convolutions.

11. An antenna structure in accordance with claim 10 in which the physical length of each of said straight sections is less than 0.075 wavelength.

12. An antenna structure in accordance with claim 10 in which the physical length of each straight section is approximately 0.0665 wavelength.

* * * * *